United States Patent [19]

Imanishi et al.

[11] 4,259,052

[45] Mar. 31, 1981

[54] TRANSFER PRESS

[75] Inventors: Shozo Imanishi, Sagamihara; Fumiaki Umezawa, Kanagawa; Toshiya Ishida, Hachioji; Harutsugu Nakayama, Sagamihira, all of Japan

[73] Assignee: Aida Engineering, Ltd., Sagamihara, Japan

[21] Appl. No.: 56,974

[22] Filed: Jul. 12, 1979

Related U.S. Application Data

[63] Continuation of Ser. No. 941,639, Sep. 12, 1978, abandoned.

[30] Foreign Application Priority Data

Jul. 15, 1978 [JP] Japan ..... 53-86440

[51] Int. Cl.[3] ..... B29C 3/06

[52] U.S. Cl. ..... 425/135; 425/143; 425/145; 425/544; 72/421; 72/419; 72/405

[58] Field of Search ..... 425/135, 143, 145, 544; 72/421, 405, 419

[56] References Cited

U.S. PATENT DOCUMENTS

| | | | |
|---|---|---|---|
| 3,526,690 | 9/1970 | Bachman | 425/135 X |
| 3,843,289 | 10/1974 | Taylor | 425/145 |
| 3,860,801 | 1/1975 | Hunkar | 425/145 X |
| 4,012,937 | 3/1977 | Imanishi | 72/419 |
| 4,024,749 | 5/1977 | Taniguchi et al. | 72/421 |
| 4,120,629 | 10/1978 | Christian et al. | 425/135 X |

*Primary Examiner*—J. Howard Flint, Jr.

*Attorney, Agent, or Firm*—Wenderoth, Lind & Ponack

[57] ABSTRACT

The transfer press has a blank-supply mechanism for supplying blanks which are materials for every kind of part to be manufactured by pressing, one by one to a press, a blank-transport mechanism for carrying blanks from the blank-supply mechanism to the press, a transfer feed mechanism for feeding blanks that have been supplied to the press one by one to dies of each stage along the bed of the press, a die exchange mechanism for exchanging dies when different parts are to be manufactured, a feed bar exchange mechanism for removing and exchanging feed bars which are a part of the transfer feed mechanism, when dies are to be changed, a die cooling oil circuit connecting mechanism for connecting a cooling circuit to a newly placed die in order to cool it, a pressure adjusting mechanism for die cushioning mounted on the bed of the press, and a program control mechanism for the automatic operation of the press, which controls the above-described mechanisms as well as the press in relation to blank supplying and manufacturing conditions.

17 Claims, 36 Drawing Figures

TRANSFER PRESS

This application is a Continuation of application Ser. No. 941,639 filed Sept. 12, 1978, now abandoned.

BACKGROUND OF THE INVENTION

The present invention relates to an all-automatic transfer press, and more particularly to a series of devices and program control mechanisms for operating the devices in order to automatically perform all operations from supplying blanks to discharging finished items in general transfer press processing.

Recently, it has become the practice to produce a wide variety of parts or products by a press and along with this conventional measures of putting finished products in stock after mass-producing them has started to cause inconveniences. For example, an increase in kinds of products in stock has presented problems of storage space, anti-corrosive measures and transferring the products out of stock, and as a result of these problems maintenance costs tend to become enormous. Thus, timely suppling of parts required to be assembled as the occasion demands has become desirable. In order to fulfill this need an all-automatic press with short access time and high productivity has become necessary. The present invention was devised to satisfy this need.

DETAILED DESCRIPTION OF THE INVENTION

An embodiment of the present invention is described hereinafter in reference to the drawings.

Figure 1:
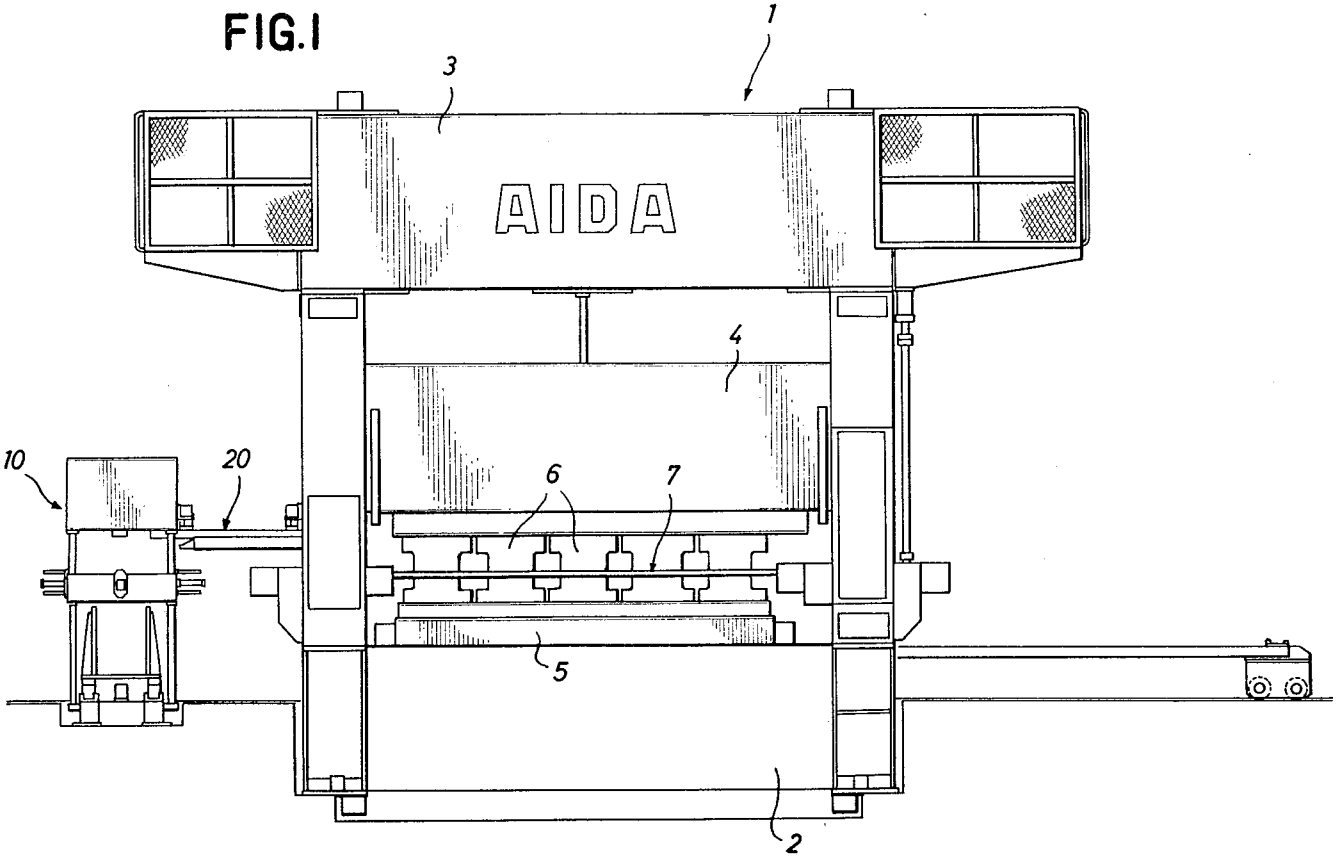
FIG. 1 is a schematic front view of the transfer press of the present invention.

In FIG. 1 is shown a schematic view of the transfer press according to the present invention. A blank-supply mechanism 10 is located in the left of a press 1, and between the mechanism and the press is a blank-transport mechanism 20. A transfer feed mechanism is located at a column 8 (see FIG. 5) and it is driven by the drive source of the press.

Figure 2:
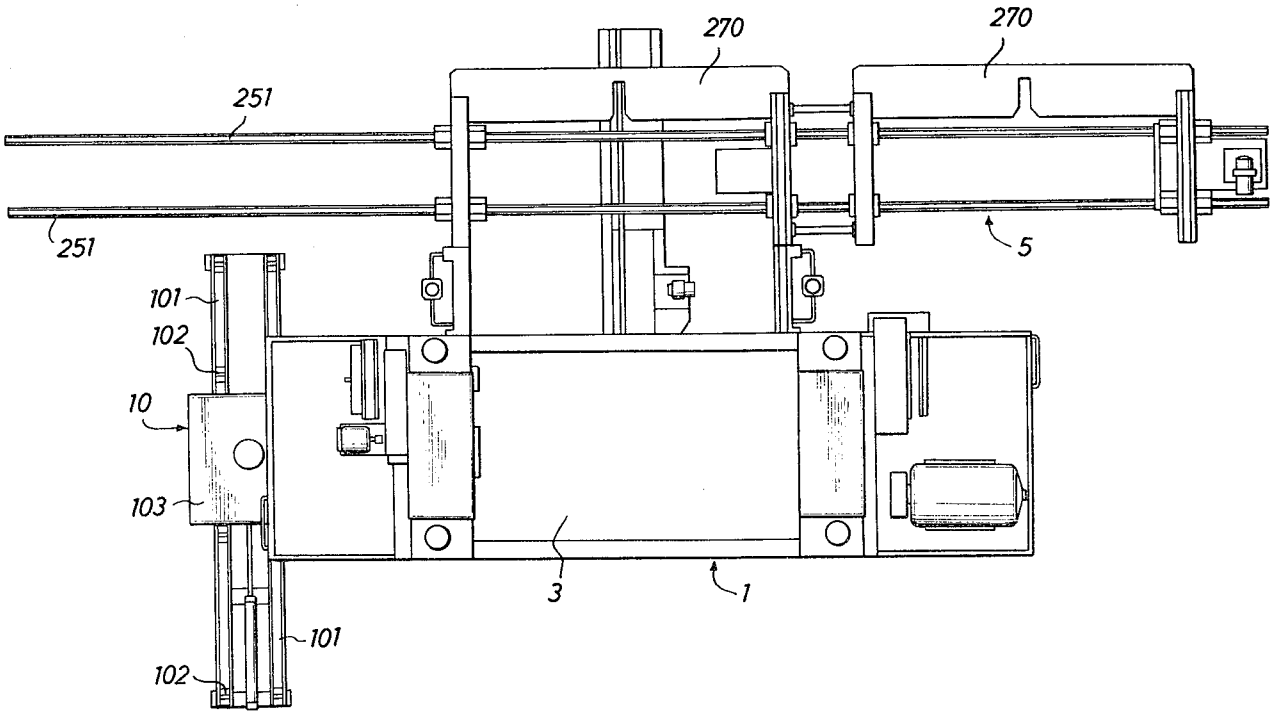
FIG. 2 is a plan view of the transfer press of the present invention.

A die exchange mechanism is located behind the press and is visible only in FIG. 2 which is a plan view of the machine. A die cooling circuit connecting mechanism is provided at a slide 4 and a die 6.

A cushion pressure adjusting mechanism is located at the longitudinal wall of a bed 2.

Figure 3:
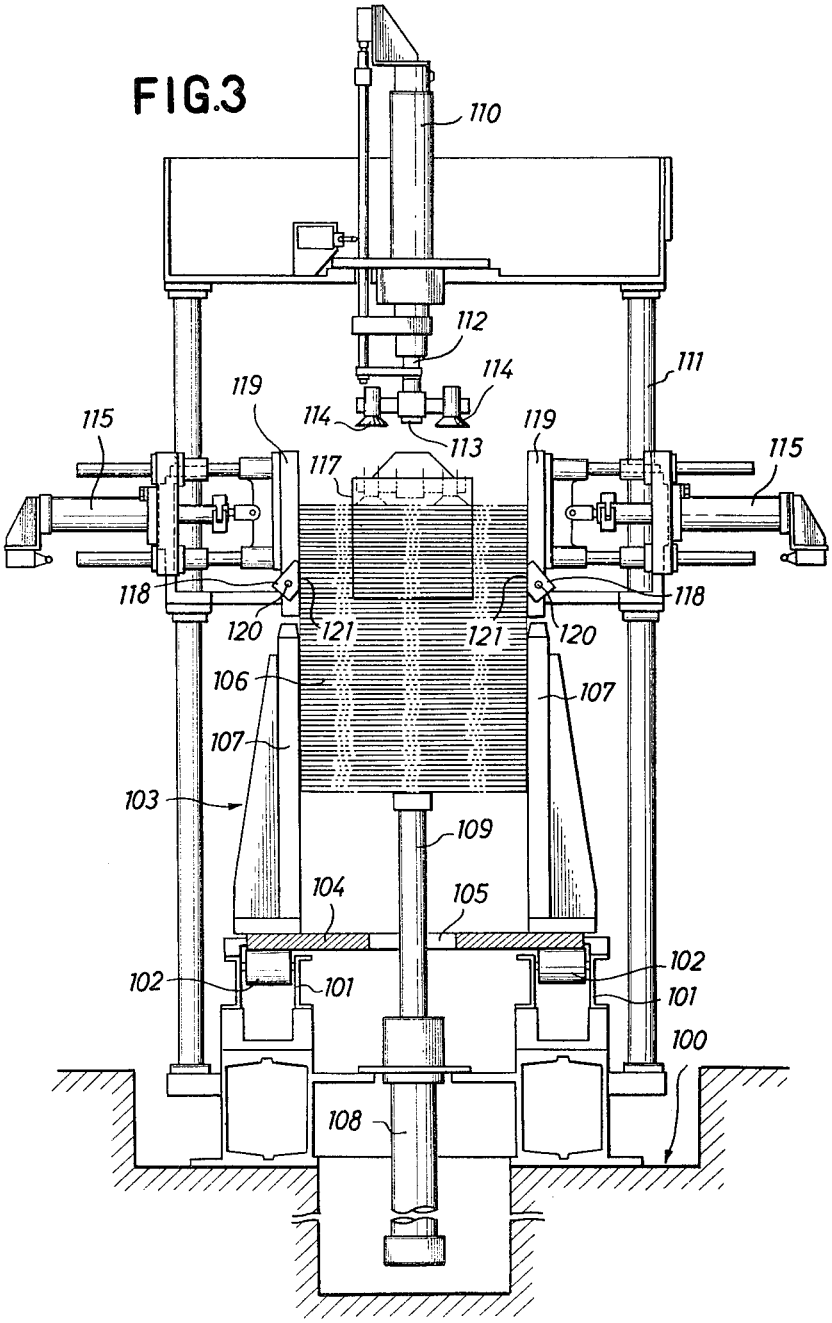
FIG. 3 is an elevational view, partly in section, of the blank-supply mechanism.

In FIG. 3 the details of the blank-supply mechanism 10 are shown. Vacuum-cup lifters 114 are mounted on a piston rod 112 of a vacuum cylinder 110 secured to a frame body 111, and they pick up blanks 106 loaded in a magazine 103 one by one from the top of a stack of blanks. The magazine 103 can move on rollers 102 mounted on rails 101, and it has blank holders 107 thereon. A hole 105 is provided in the bottom of the magazine 103 so that a piston rod 109 of a lift cylinder 108 which pushes up the blanks 106 can pass therethrough.

The lift cylinder 108 is secured to rails 101, and it keeps the height of loaded blanks 106 within a certain limit. The cylinder is provided with a detector to sense the stroke of the piston rod 109.

A magnet floater 117 is located at the side of the top of the stack of blanks 106 and is freely movable in order to separate the blanks from one another.

Figure 4:
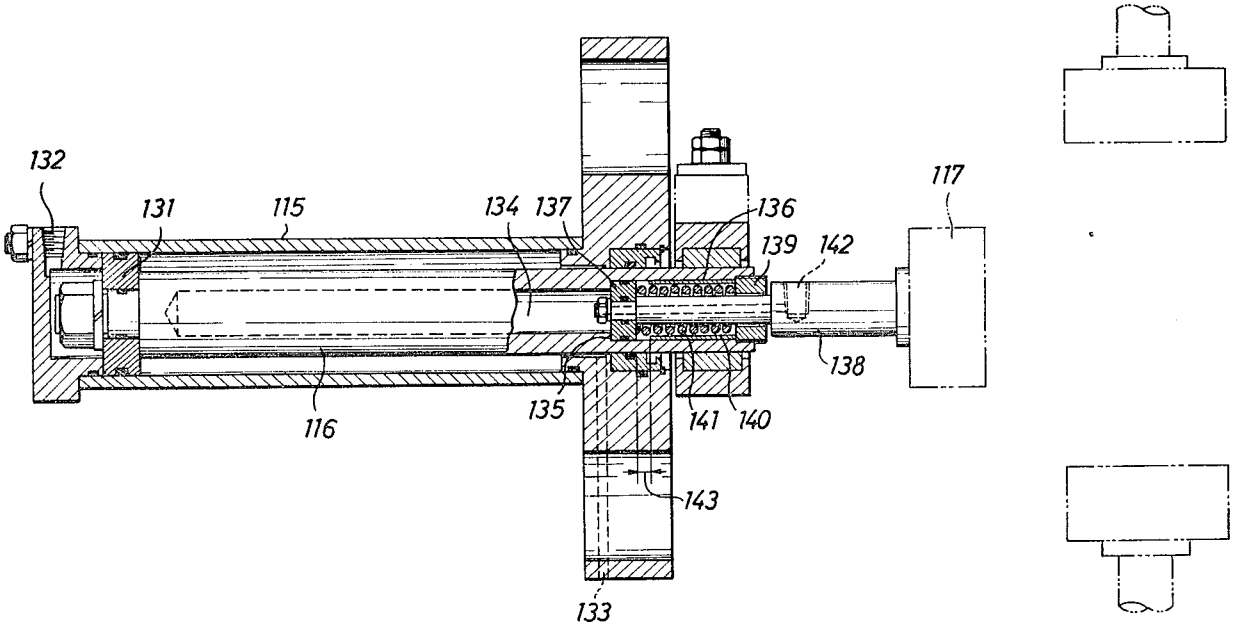
FIG. 4 is a sectional view of the cylinder of the blank-supply mechanism which operates the magnet floater and the blank-supporting fixture.

Referring to FIGS. 3 and 4, the magnet floater 117, and plates 119 with blank support members 118 pivoted thereon are each secured to one end of a corresponding rod 138. A piston 137 is also secured to the other end of each rod 138 and is slidable in the bore in a piston rod 116. A plug 139 is mounted in the opening of the bore in the piston rod 116, and spring 141 and a tube 140 are provided between the pistons 137 and the plug 139. A clearance 143 is formed between the piston 137 and the tube 140, or between a seat 135 and the piston 137. A piston 131 is secured to the piston rod 116 and is slidable in a cylinder 115.

When pressure fluid is suppled to an inlet hole 132, piston 131 moves in cylinder 115 moving the magnet floater or plates 119 to the right in FIG. 4 until they strike a side surface of the stack of blanks 106, and the contact is detected by a detector (not shown). Pressure fluid is also supplied to inlet 142 and through bore 136 in rod 138 to space 134 within rod 116, which moves piston 137 to the right to move rod 138 to the right by the amount of clearance 143. Supply of pressure fluid to holes 132 and 142 is cut off by the signal from the detector. Then the spring 141 urges piston 137 to the left and the clearance 143 is again formed between the tube 140 and the piston 137, whereby a clearance corresponding to the clearance 143 is formed between the stack of blanks 106 and the magnet floater 117 or the plates 119. The magnet floater and plates are in their proper positions at this point.

The blank-supports 118 are mounted on the plates 119 to be pivotable in one direction on a shaft 120 and they are structured to rotate toward the blanks when the blanks 106 are pushed up by the lift cylinder 108 and past these supports.

When the number of blanks 106 have been reduced to a certain number, the lowermost blank is pushed past the support 118, and the piston rod 109 is moved down and the remaining blanks are supported by the blank-supports 118. The emptied magazine then runs on the rails 101 out of the blank supply mechanism, and a newly loaded magazine 103 is supplied. In the meantime supplying of the blanks 106 to the press continues from the portion of the stack supported on the supports 118.

The blank 106 engaged by the vacuum-cup lifters 114 is lifted by the vacuum cylinder 110, and in the lifted postion it is engaged at different places by the vacuum-cup lifters of a vacuum transport device. Vacuum-cup lifters 114 are then disengaged so that the blank is transferred to the new lifters. The vacuum transport device will be described below.

The blank-transport mechanism supplies the blank 106 picked up by the vacuum-cup lifters 114 from the blank-supply mechanism to the first stage of the press by up and down movements of the rods of cylinders 162 for lifting and lowering the vacuum-cup lifters 114.

Figure 5:
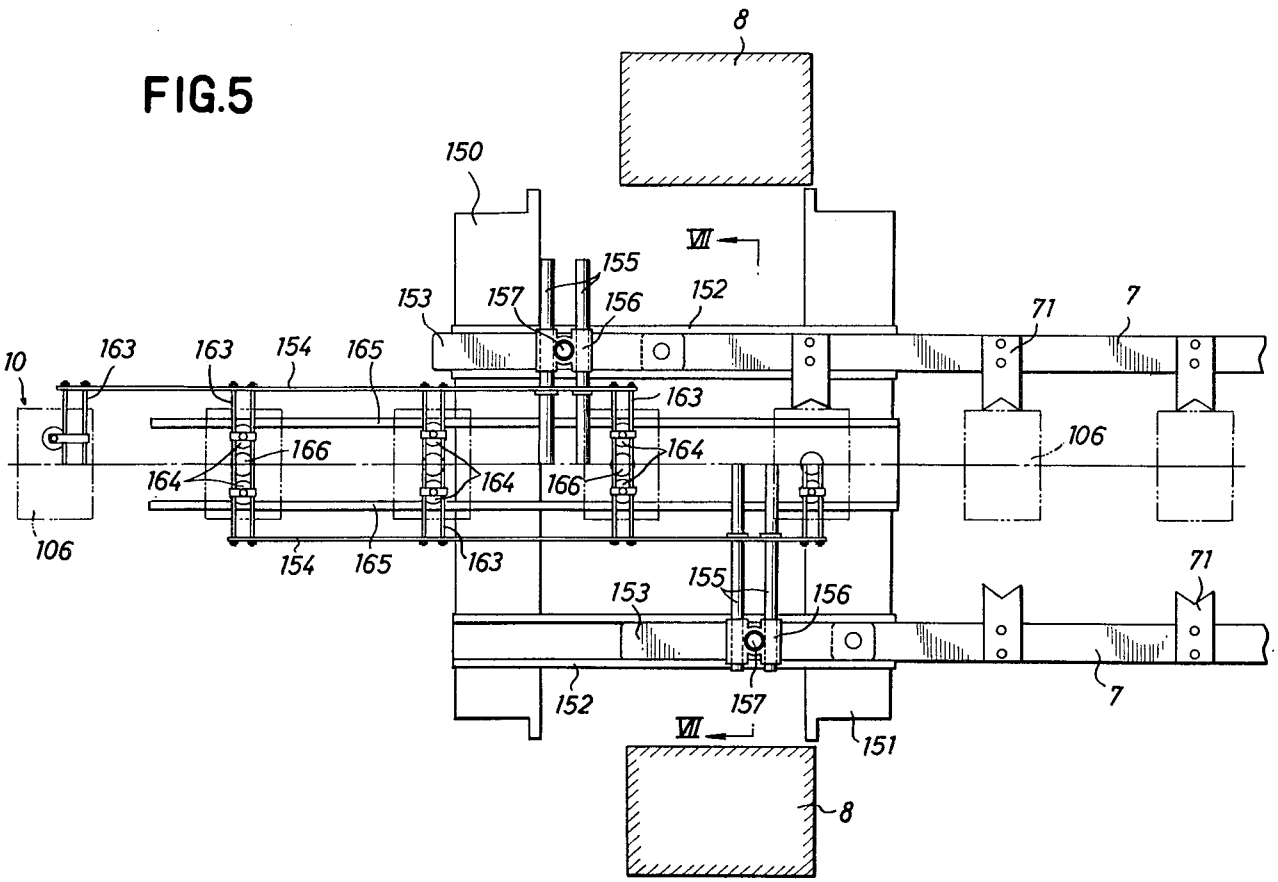
FIG. 5 is a plan view of the blank-transport mechanism in which above the center line is shown the end of the feed bar and the transfer frame in the return position and below the center line is shown the feed bar and transfer frame in the advanced position.

As seen in FIG. 5 clamp units 150 and 151 which operate to clamp to and unclamp from the feed bars 7 are secured to columns 8 are connected to feed bar guides 152. In guiding grooves of the feed bar guides 152 are supported auxiliary feed bars 153.

The feed bars 7 are connected at the left ends to the auxiliary feed bars 153 and at the right ends to the auxiliary feed bars 304, (see FIG. 21) respectively, by connecting pins 307. These connections will be described later in the specification.

Figure 6:
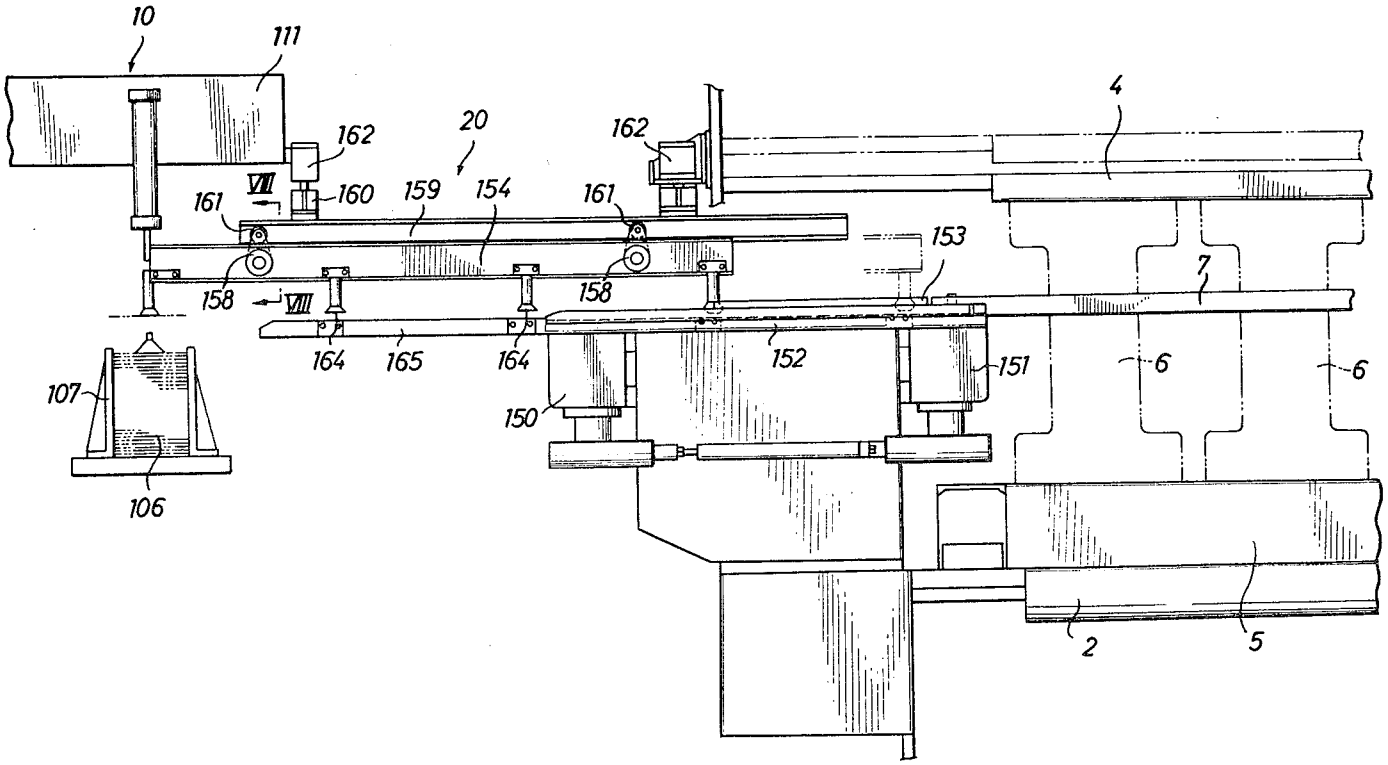
FIG. 6 is a front view of the blank-transport mechanism in which the transport frame has reached the return end.
Figure 7:
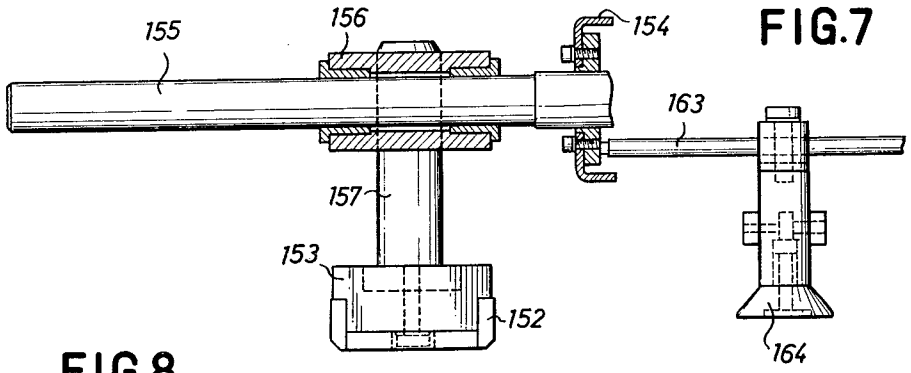
FIG. 7 is a partial side sectional view along line VII—VII of FIG. 5.
Figure 8:
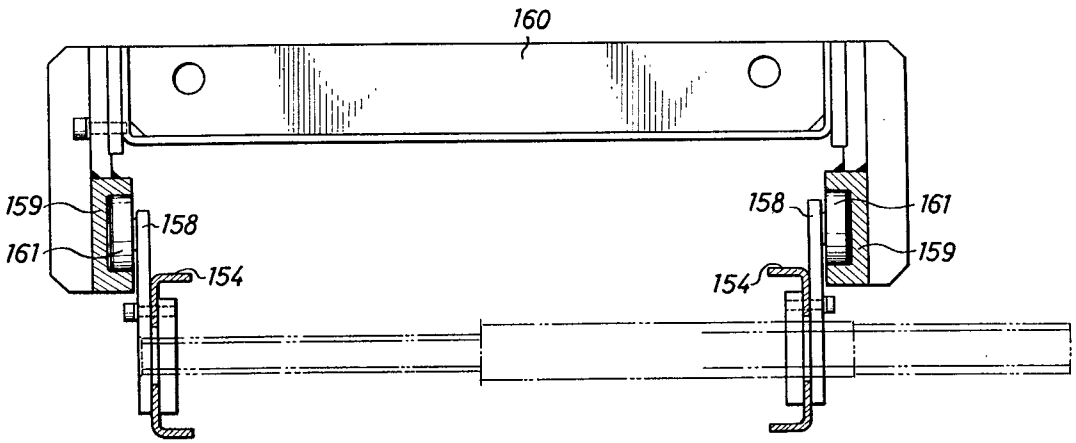
FIG. 8 is a section along the line VIII—VIII of FIG. 6.

As seen in FIG. 7 a drive pin 157 provided on the auxiliary feed bar 153 extends into a hole in a sliding member 156 guided by guide rods 155 secured to a transport frame 154. As seen in FIGS. 6 and 8 the transport frames 154 have arms 158 extending upward therefrom, and rollers 161 mounted on the ends of the arms 158 are engaged in guide grooves provided in the rails 159. The rails, in turn, are secured to bridges 160 which are mounted on cylinders 162 which in turn are mounted on a frame body 111 of the blank-supply mechanism and to the column 8 of the press.

As seen in FIG. 7 vacuum-cup lifters 114 are mounted on connecting rods 163 between frames 154 and are spaced at same intervals as the dies in the press.

As seen in FIGS. 5 and 6, a base 165 is provided parallel to the feed bars 7 and above clamp units 150 and 151. Vacuum-cup lifters 114 are secured at postions that correspond to so-called "idle stages" between die mounting positions of the press.

Figure 9:
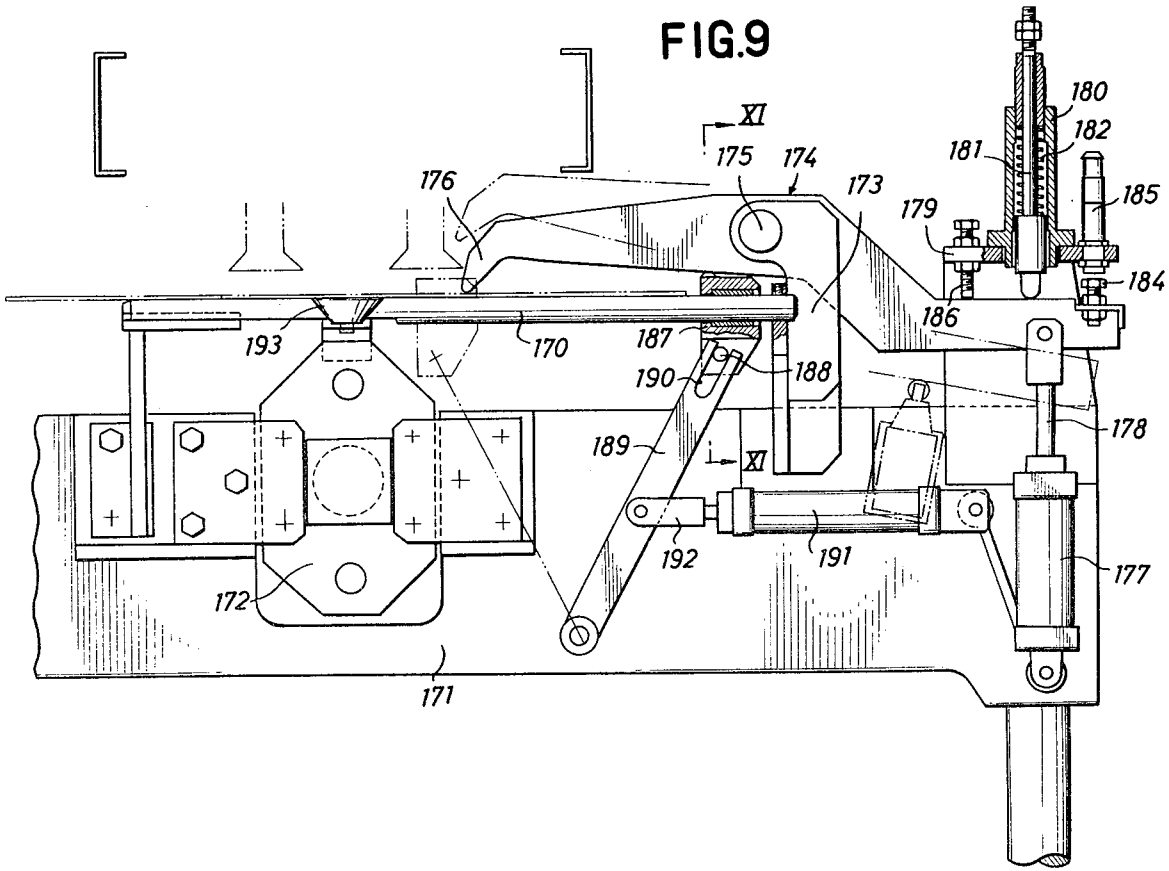
FIG.9 is a side view, partly in section of the double blank detecting mechanisms.
Figure 10:
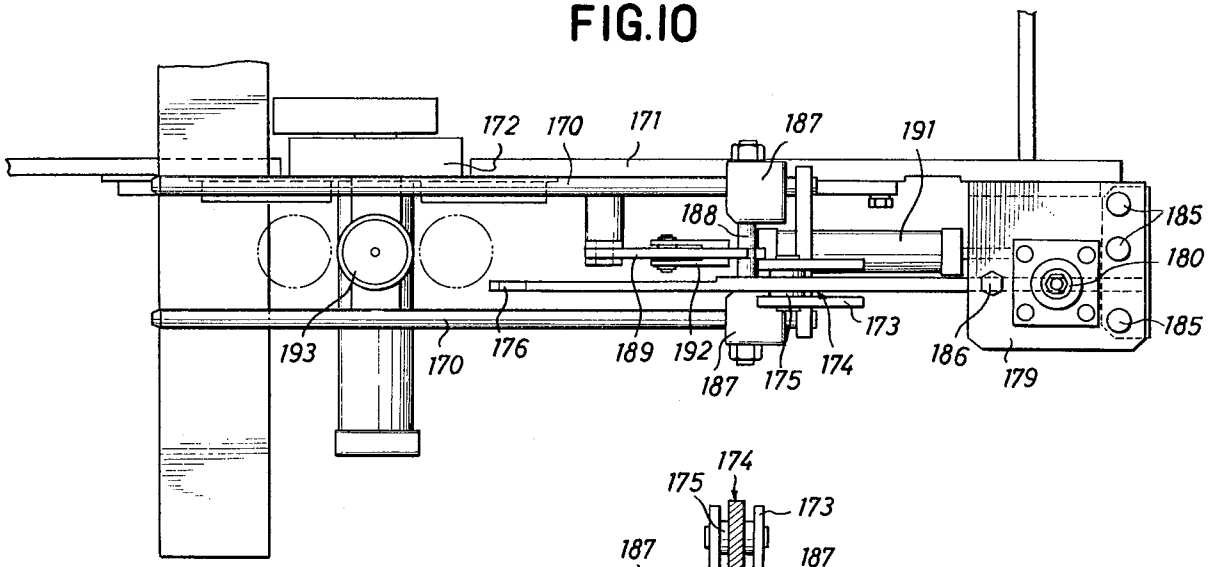
FIG. 10 is a plan view of the double blank detecting mechanism.
Figure 11:
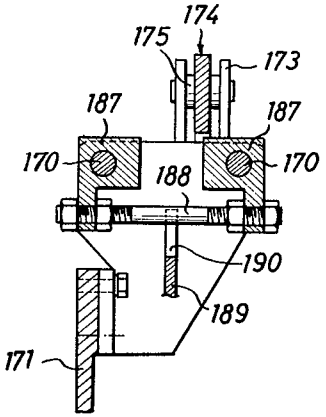
FIG. 11 is a section along line XI—XI of FIG. 9.

FIGS. 9 to 11 show a mechanism which detects lifting of two or more blanks at one time and which, in such case, ejects them all. In FIG. 9 the thickness of a blank or blanks on a blank receiving rod 170 which extends in a direction perpendicular to the blank transport direction, is sensed by a contact arm 176 on a rotatable lever 174 driven by a cylinder 177 and an adjacent switch 185. When more than two blanks are detected, they are pushed off.

The contact member 176 is provided at one end of the lever 174 mounted rotatable on the machine frame 171, and a piston rod 178 of the cylinder 177 is pivotally connected to the other end. An operation member 184 is also provided at this end of the lever.

A proximity switch 185 is provided in a position where it is connected by the operation member 184 upon pivoting of the lever 174. An adjusting screw 186 and a cushion shaft 181 are provided at positions at which they will be contacted by the lever 174 during its movement.

A slider 187 which ejects blanks when two or more of them are detected, is slidable along a shaft 175 fixed to the machine frame 171. The bottom of the slider 187 is engaged with the forked end 190 of a swing rod 189 through connecting pin 188.

The other end of the swing rod 189 is pivotally mounted on the machine frame 171 by a pin, and at its center it is pivotally connected to the piston rod 192 of the cylinder 191. Each time a blank arrives opposite lever 174, cylinder 177 is driven to pivot lever 174 counterclockwise. If only one blank 106 is present on rods 170, the right hand end of the lever 174 will contact switch 185, and a signal will be given permitting the blank 106 to advance. If lever 174 cannot pivot sufficiently far, no signal will be generated by switch 185, and cylinder 191 will be actuated to eject the blanks by movement of slider 187 to the left.

A blank 106 picked up by vacuum-cup 114 and lifted by the vacuum cylinder 110 in FIG. 3, is transferred to the vacuum-cup lifters 164 (vacuum-cup lifters 114 and 164 engage the blank at different positions) and is advanced a distance corresponding to a feed stroke by the advancing movement of the transfer frame in FIG. 6. By the action of the cylinders 162, the blank 106 then is lowered and received by the vacuum-cup lifters 166 secured to the bed 165. After releasing the blank 106, the vacuum-cup lifters 164 ascend and return to their original positions by the return movement of the transfer frame 154. Then, the vacuum-cup lifters 164 are lowered by the cylinders 162 to pick up the next blank 106 being lifted by the vacuum-cup lifters 114, and are again raised by the action of the cylinders 162 and advance. The vacuum-cup lifters 164 are again lowered to transfer the next blank 106 to the vacuum-cup lifters 166, and ascend again. In this manner, the vacuum-cup lifters repeat the same cycle.

The presence of a blank 106 on the bed 165 is detected by the proximity switch 185 in FIG. 9, and if more than two of them are present, they are ejected by the slider 187.

According to this series of action, the blanks are transferred one by one to the first stage of the press.

Figure 12A:
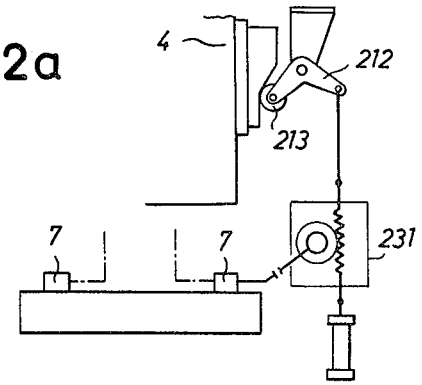
FIG. 12*a* is a schematic side view showing the transfer operation.
Figure 12B:
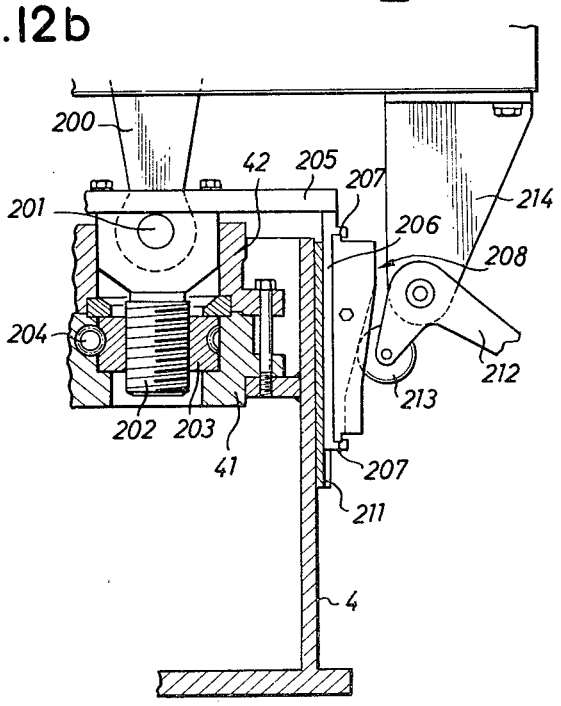
FIG. 12*b* is a side view, partly in section and on an enlarged scale, of the switch-over mechanism for a three-dimensional and two-dimensional transfer operation.
Figure 13:
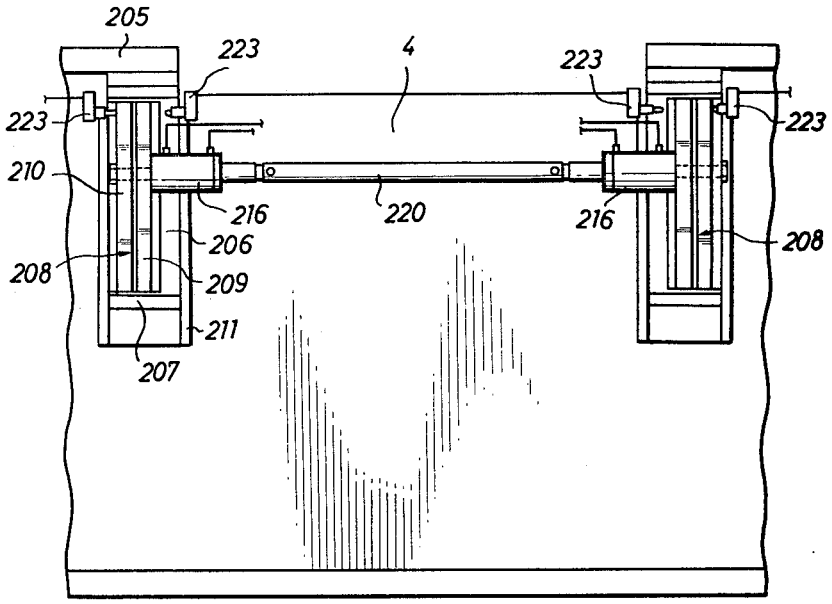
FIG. 13 is a fragmentary front view of the switch-over mechanism for three-dimensional and two-dimensional transfer operation.
Figure 14:
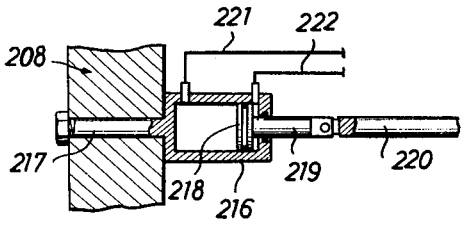
FIG. 14 is a sectional view of the cylinder which is connected to a cam to permit three-dimensional and two-dimensional operation.

In FIGS. 12 to 14 are shown a switching mechanism for the second and third stages of blank transfer, i.e. a mechanism for controlling the clamping and unclamping movements of the feed bars 7.

Two cam holders 206 are mounted at points spaced along slide 4. The slide 4 has a casing 41 mounted thereon which has a nut 103 rotatably mounted therein. A slide adjusting screw 202 is threaded into the nut 203. Screw 202 is connected by a pin 201 to a connecting rod 200 on a crankshaft (not shown) in frame 3. When the regular sliding movement is stopped, the nut 203 is rotated by the threaded rod 204, the nut moves along the screw 202 and the slide 4 moves with the casing 41. In this manner, the slide is operated to set its position at the bottom dead center position of the crankshaft. Also, the cam holder 206 is connected to the connecting rod 200 by member 205, and is slidably connected to the slide 4 by a slide member 211 so that its position does not change even when the position of slide 4 is changed. Further, a cam means 208 is provided and is slidable in the lateral direction in the grooves 207 formed in the cam holder 206 parallel to the horizontal length of the holder. The cam means 208 consists of a cam 210 for two dimensional movement of the feed bars 7 and cam 209 for three-dimensional movement of the feed bars.

Cylinders 216 are mounted on the inner surface of the cam means 208, and piston rods 219 of the pistions 218 in cylinders 216 are connected to each other by a connecting rod 220.

On both sides of each cam means 208 are limit switches 223 which detect movement of the cams along the slide 4.

A lever 212 is pivotally mounted on a bracket 214 which is fixed on the frame 3 adjacent each cam means 208. The lever has a cam roller 213 on one end which engages with the cam means 208, and its other end is connected to clamp-and-unclamp unit 231 through a longitudinal rod **212*a* and a rack and pinion mechanism 231*a***.

During movement of the cam means 208 up and down in accordance with the movement of the connecting rod 200 relative positions of the cam means and the rollers 213 change to pivot lever 212. The cam means 208 is shifted in the horizontal direction to engage rollers 213 with the two-dimensional cams 210 or the three-dimensional cams 209 by the action of the cylinders 216.

FIG. **12*a* shows schematically how up and down movements of the slide 4 produce the clamp-and-unclamp movements of the feed bars 7 through the cam means 208, lever 212, longitudinal rod 212*a* and clamp-and-unclamp units 231**.

Figure 15:
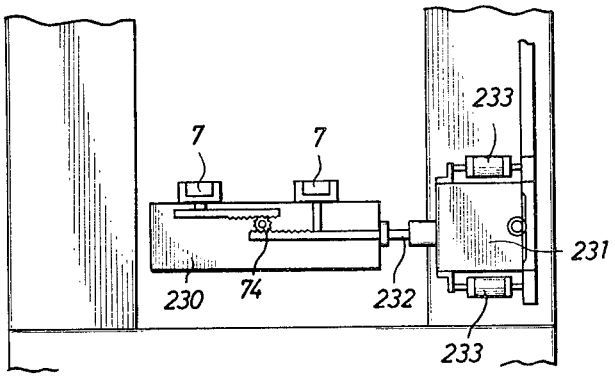
FIG. 15 is a schematic side view of the clamp inner width change-over mechanism.
Figure 16:
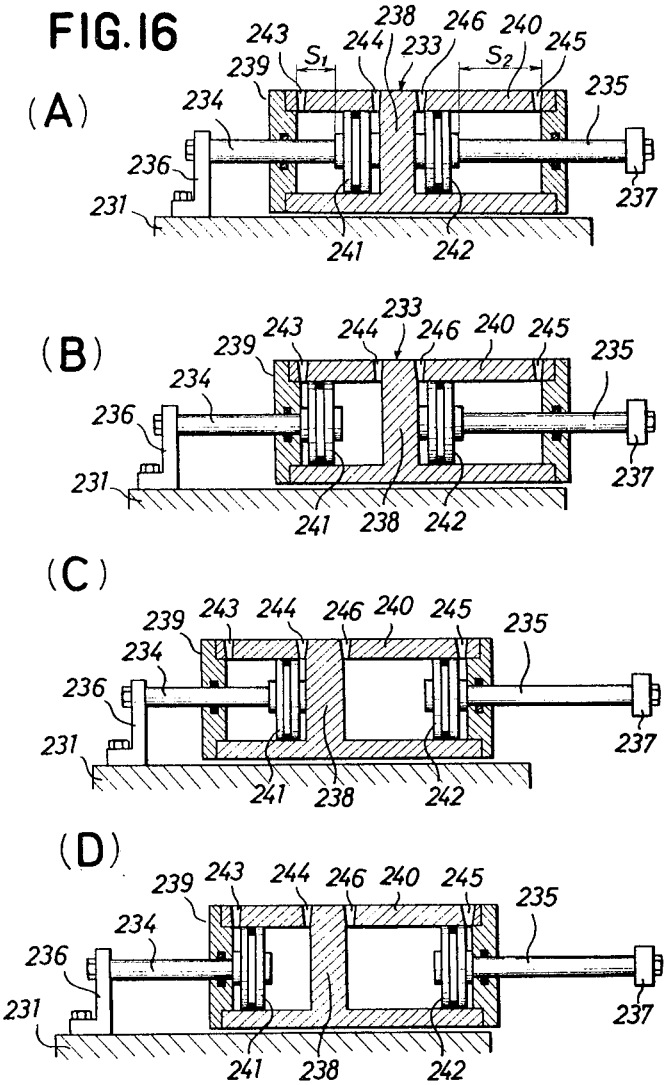
FIGS. 16A, B, C and D are detailed sectional views of the clamp inner width change-over mechanism, each showing a different advance of the mechanism.

As shown in FIG. 15 the casing for the clamp-and-unclamp units 231 has two duplex cylinders 233. Each has cylinders 239 and 240 with inlets and outlets 243, 244, 245 and 246, respectively. The cylinders are on opposite sides of a partition 238 as shown in FIG. 16, and the respective strokes of pistons 241 and 242 in the cylinders are S1 and S2. The piston rods 235 of the duplex cylinders are fixed to a column 8 by bracket 237 while the other piston rods 234 are fixed to a bracket 236 on the casing 231.

A drive shaft 232 which is driven by the up and down movements of the slide 4 is connected between each unit 231 and the feed bars 7 through a rack and pinion mechanism 74 for simultaneously shifting the feed bars in opposite directions. Such a mechanism is disclosed in U.S. Pat. No. 4,024,749.

As seen in FIGS. 16A–16D the positions of the clamp-and unclamp units 231 can be any one of four positions according to the combination of the strokes S1 and S2 of the two cylinders 233. The length of strokes S1 plus S2 is the maximum width adjustment of the pair of feed bars 7.

FIGS. 17–20 is a die exchange mechanism for replacing a die in the press 1 by another. This is positioned behind the press as shown in FIG. 2. A bolster 5 is provided in the bottom of the press (FIG. 1) and supported on bed 2 and on which a die is placed and is movable back and forward in the press (up and down in FIG. 17) while a truck 270 on which the bolster is carried runs from side to side. There are two of these trucks, each having a bolster, and they are connected to each other by connecting rods 272.

Extending to the rear from the bed 2 are rails 250 at the same level as that of the bed and which are connected to it, and at the rear ends of rails 250 are floor rails 251 which extend perpendicularly to rails 250. The rails 250 support the bolster 5 being moved into or out of the press, while the floor rails support the trucks 270.

Figure 18:
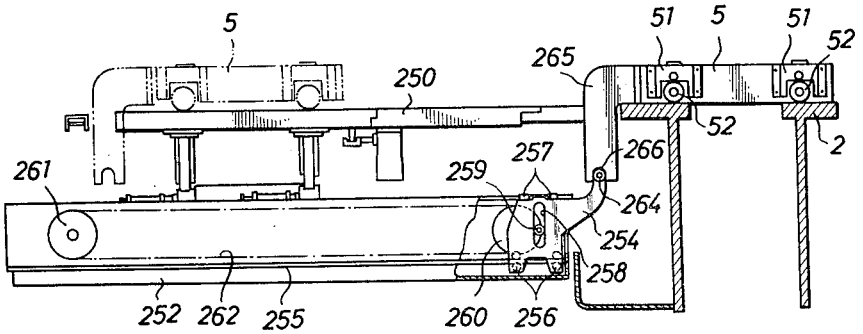
FIG. 18 is a side view taken from the direction of line XVII—XVII of FIG. 17, one portion of which is shown in section.

In FIG. 18 the bolster 5 is shown as having wheel casings 51 with wheels 52 running on rails 250, and on the bed 2 is provided an elevator (not shown) at the positions of the wheels 52 when the bolster is in place. When the bolster is to run on the rails 250 the elevator is actuated to raise the bolster off the rails.

A connecting plate 265 is secured to the bolster 5, and at the bottom it has a U-shaped recess for receiving a roller 264 on a slider 254. On the bottom of the slider 254 are rollers 256 which engage the opposite sides of the rail 255 and a roller 257 which is in contact with the inner wall of a guide groove 253 in a track 252.

The slider 254 has a longitudinal groove 258 therein in which is fitted a roller 259. This roller is connected to a chain 262 which runs in the guide groove 253 and is driven by a motor 263 through sprockets 260 and 261.

Figure 17:
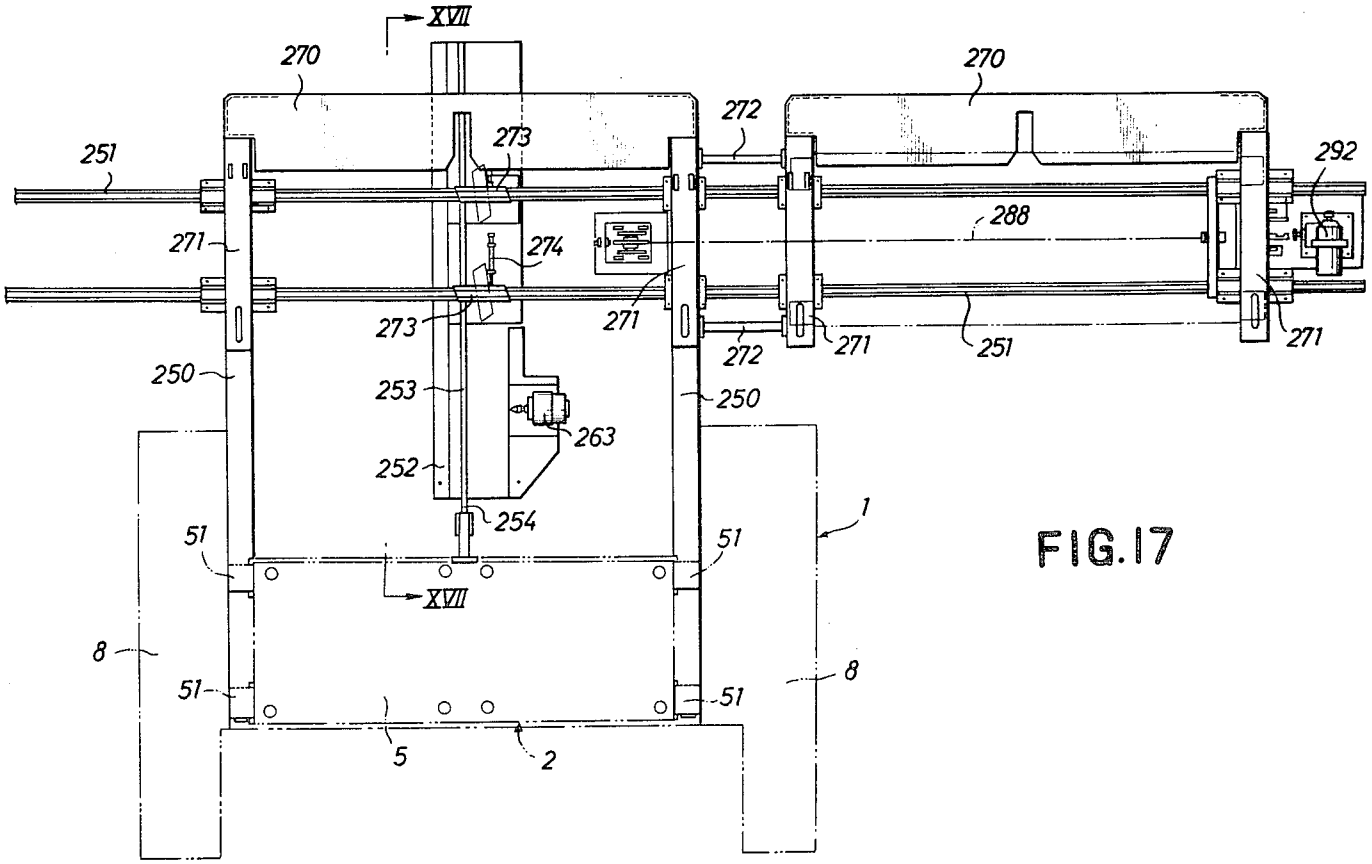
FIG. 17 is a plan view of the die exchange mechanism.
Figure 20:
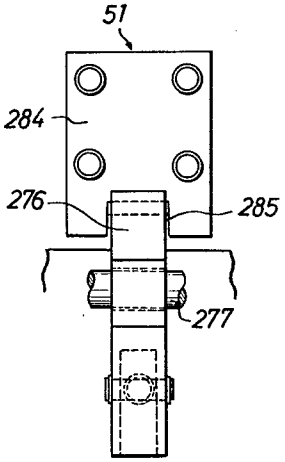
FIG. 20 is a front view of a stop plate provided at the wheel casing of the bolster.
Figure 19:
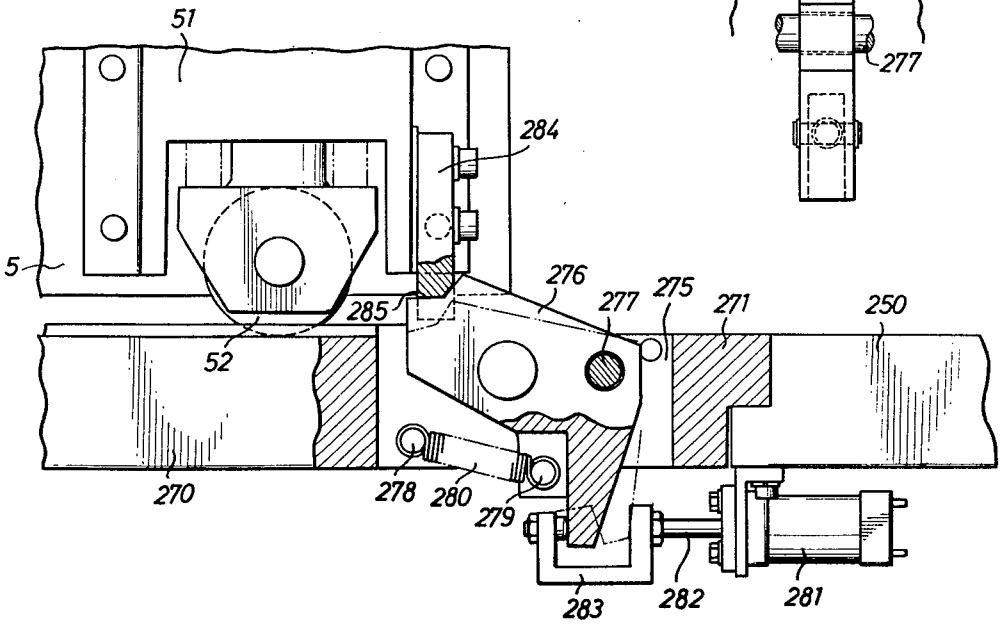
FIG. 19 is a side view which shows the connection of the truck and the rails in detail and partly in section.

As shown in FIG. 17 the truck 270 is connected to a chain 288 which is driven by a motor 292 parallel to the floor rails 251, so that the truck runs on the floor rails. The truck 270 has on its upper portion cross rails 271 which are parallel to and at the same height and same spacing as the rails 250. The cross rails 271 are provided at one end (left end in FIG. 18) with a stop, not shown, and with holes 275 therethrough (FIG. 19) at the other end (right end in FIG. 18) inside of which are stop devices for securing bolsters. A stop plate 276 is pivotally mounted on pin 277 in hole 275 and has one end engaged in an engagement groove 285 in a stop plate 284. The bolster will thus be held between the stops so that the movement of the bolster 5 is restricted in the direction of movement of the bolster 5 along rails 270, and by the engagement of the stop plate in groove 285, the bolster is restricted against movement in the direction perpendicular thereto. The stop plate 276 is pivoted out of the groove 285 by the cylinder 281 having bracket 283 on the end of piston rod 282 thereof, against the action of spring 280 connected to pin 278 on rail 271.

As shown in FIG. 17 connecting rails 273 are provided at the intersectons of the floor rails 251 and the track 252 for the slider. The connecting rails are rotatable and can be connected to and disconnected from the floor rails.

Also, the die exchange mechanism is provided with several detectors which control the running of the bolsters 5 and the trucks 270.

In this die exchange mechanism, the bolster 5 which carries a die which has already been used in the press 1, is moved along the rails 250 and the cross rails 271 and placed on one truck 270 and this truck 270 is moved along rails 251 away from the press. Then another truck 270 which carries another bolster 5 with a new die to be used, is moved along rails 251 until it comes to the rear of the press 1 where the bolster is moved into the press along the rails 250 for die exchange. The movement of the trucks 270 and the bolsters 5 is automatic.

Mounting of dies in the press is by means of conventional clmaping devices.

FIGS. 21–25 show the feed bar exchange mechanism which detaches the feed bars 7 between the right and left columns and exchanges them together with the dies at the time of die exchange.

Figure 21:
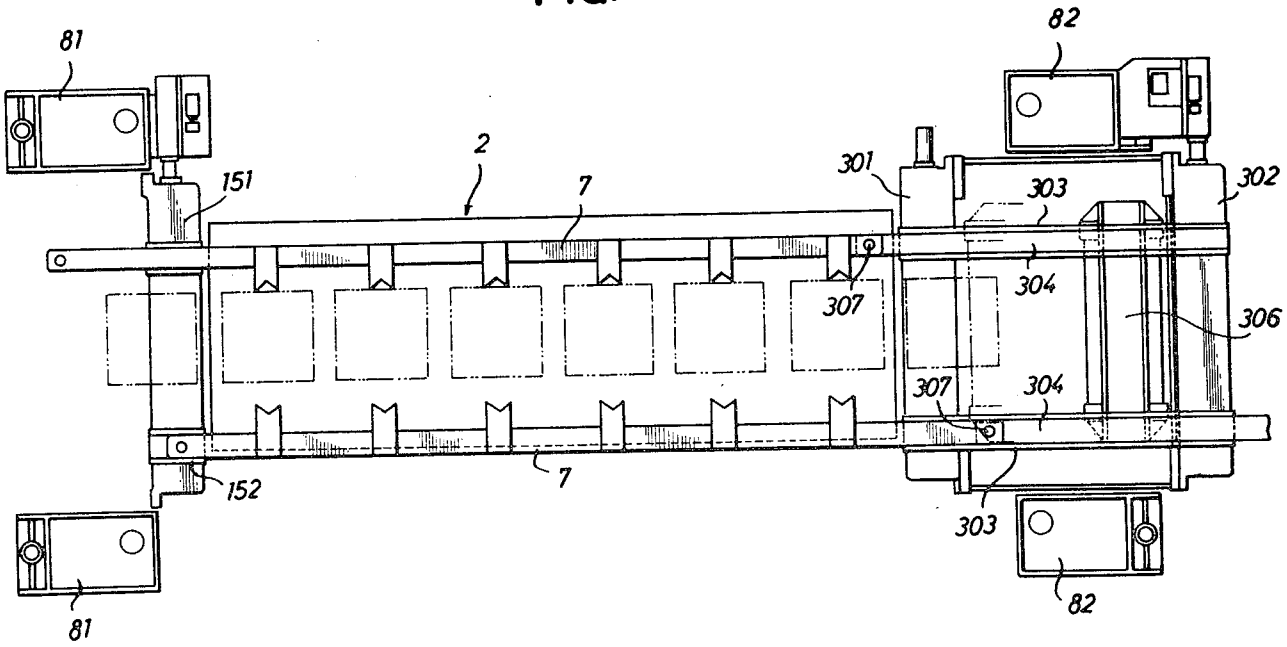
FIG. 21 is a schematic plan view of the feed bars.

As shown in FIG. 21 a transfer unit 300 for advancing and returning the feed bars 7 and clamp-and unclamp units 301 and 302 for clamping and unclamping feed bars are provided at the right column 82. At the left column 81 a clamp unit 151 is provided. Feed bar guides 303 and 152 are connected respectively to clamp-and-unclamp units 301 and 302 and clamp unit 151, and auxiliary feed bars 304 and 153 (153 is not shown in this Figure) are also respectively fitted in the grooves of the feed bar guides 303 and 152. The ends of the auxiliary feed bars and feed bars 7 are joined and connected by connecting pins 307.

The feed bar guides are provided with notches in their bottoms and by utilizing these notches a transferring slider 306 and the auxiliary feed bars 304 are connected to each other. With regard to other components of the feed bar exchange mechanism, a conventional transfer mechanism and clamp mechanism are employed.

Figure 22:
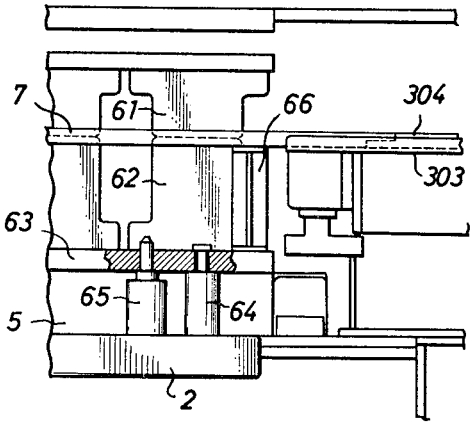
FIG. 22 is a front view of the connecting mechanism of the feed bars, showing a feed bar and an auxiliary feed bar connected to each other.

As shown in FIG. 22 a lift cylinder 65 mounted on the bolster 5 supports a common plate 63 for the lower die 62 and a bed 66 secured to this plate supports the feed bars. A clamper 64 is also mounted on the bolster 5 which connects the common plate 63 and the bolster.

Figure 23:
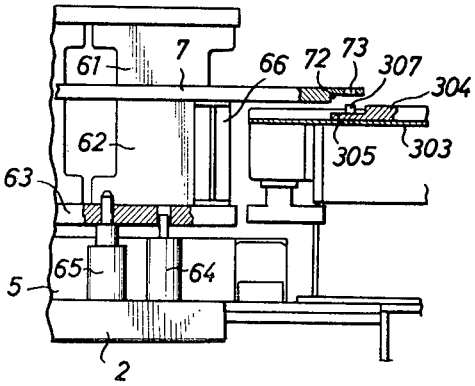
FIG. 23 is a front view showing the disengagement of the feed bar and the auxiliary feed bar of FIG. 22.

As shown in FIG. 23, when the dies are to be exchanged the feed bars 7 are raised by raising the common plate 63 for the lower die 62 by means of cylinder 65 whereby the feed bars 7 are detached from the connecting pin 307.

Figure 24:
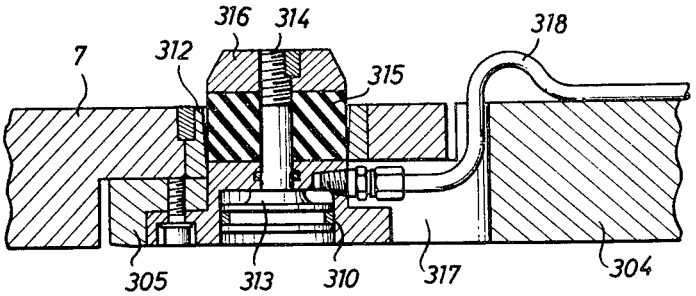
FIG. 24 is an enlarged sectional view showing a different embodiment of the feed bar engagement mechanism.
Figure 25:
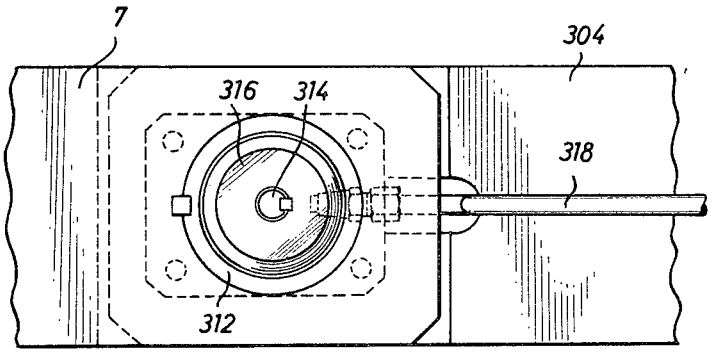
FIG. 25 is a plan view of the engagement of the mechanism of FIG. 24.

In FIGS. 24 and 25 are shown a structure of the connecting pin which prevents disconnection of the feed bars 7 and the auxiliary feed bar 304 at the time of high-speed operation of the bars. An oil pressure cylinder 310 and a piston 313 are provided on the auxiliary feed bar 304, and an elastic body 315 is inserted between the upper surface of the reduced thickness portion 305 projecting from the auxiliary feed bar 304 and the bottom of a head plate 316 secured to the piston rod. In order to expand the elastic body 315 in its radial direction, the elastic body 315 is pressed in the axial direction by supplying oil pressure to the oil pressure cylinder 310 through tube 318 extending through groove 317.

Figure 26:
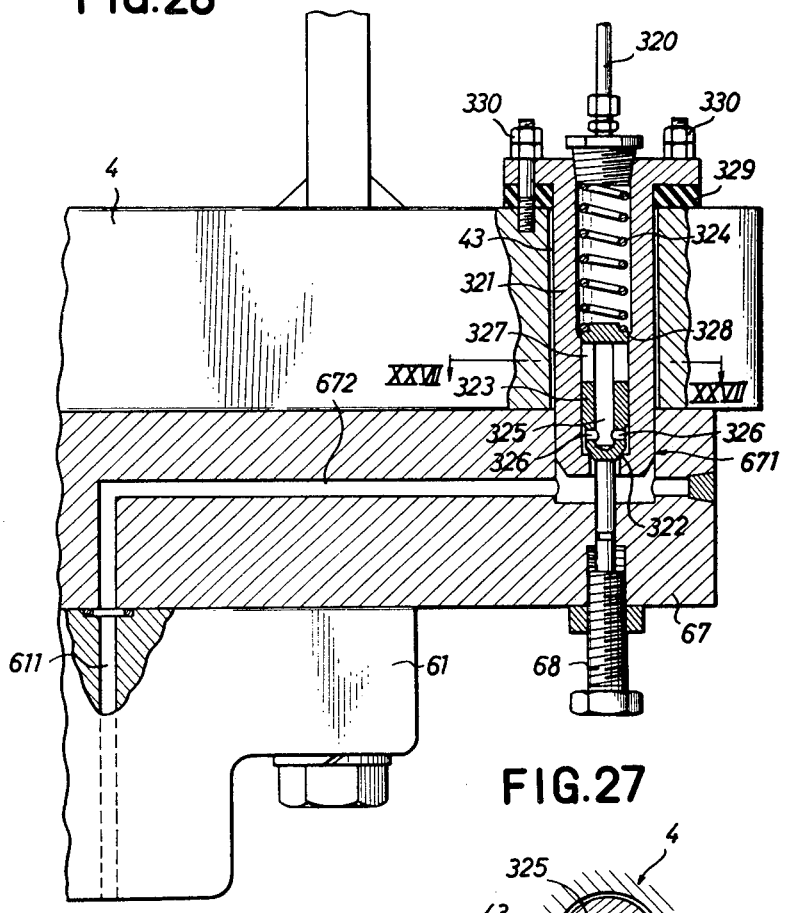
FIG. 26 is a side view, partly in section, of a communicating mechanism of the die cooling oil circuit.
Figure 27:
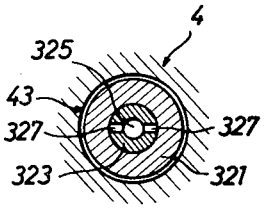
FIG. 27 is a sectional view on line XXVII—XXVII of FIG. 26.

In FIG. 26 is shown a change-over mechanism for a cooling oil circuit for cooling oil supplied to the dies 61. It carries out automatic connection of the cooling oil circuit by utilizing up and down movements of the slide 4 at the time of the exchange of dies. A check valve 321 for each die is secured in a bore 43 in the slide 4 by bolts 330 clamping a rubber gasket 329 between the valve 321 and slide 4. The check valve 321 has a plug body 323 slidable in sealing engagement in the interior thereof, and the lower reduced diameter end of the plug body engages the bottom of the hollow interior of the check valve in sealing engagement with the surface 322 of the check valve around a bottom aperture. The plug body 323 has a longitudinal bore 325 and lateral holes 326 opening out of the bore in a lower reduced diameter portion thereof, and slots 327 opening out of the upper portion. A cap 328 is mounted on the upper end of the plug body. A spring 324 pushes the plug body 323 down into sealing engagement with the surface 322 around the aperture. when the check valve 321 lifts off the sealing surface 322, a passage for cooling oil is formed through the plug body 323. The check valve 321 has a closing plug connected to an oil pipe 320 for feeding oil into the space in which are housed the plug body 323 and the spring 324. The oil pipe 320 is connected to a means to supply cooling oil.

A concave recess 671 is provided in the common plate 67 for the upper dies at a position which corresponds to the check valve 321 and a cooling oil passage 672 extends from the concave recess to the cooling oil supply bore 611 in the upper die 61 through the common plate 67.

A flow rate adjusting bolt 68 is threaded into the bottom of the common plate 67 and projects into the concave recess 671 with the end thereof in contact with the plug body 323.

When a die is to be removed, the end of the plug body 323 is moved away from the end of the adjusting bolt 68 upon the ascent of the slide 4 and the plug is driven against the surface 322 by the action of the spring 324 to close the valve. Supply of cooling oil to the die is thus stopped. On the other hand, when a new die is placed in position, the plug body 323 is pushed up by the adjusting bolt 68 when the slide 4 descends to move the plug body 323 away from surface 322, and the passage for cooling oil is thus opened to enable supplying of oil.

Figure 28:
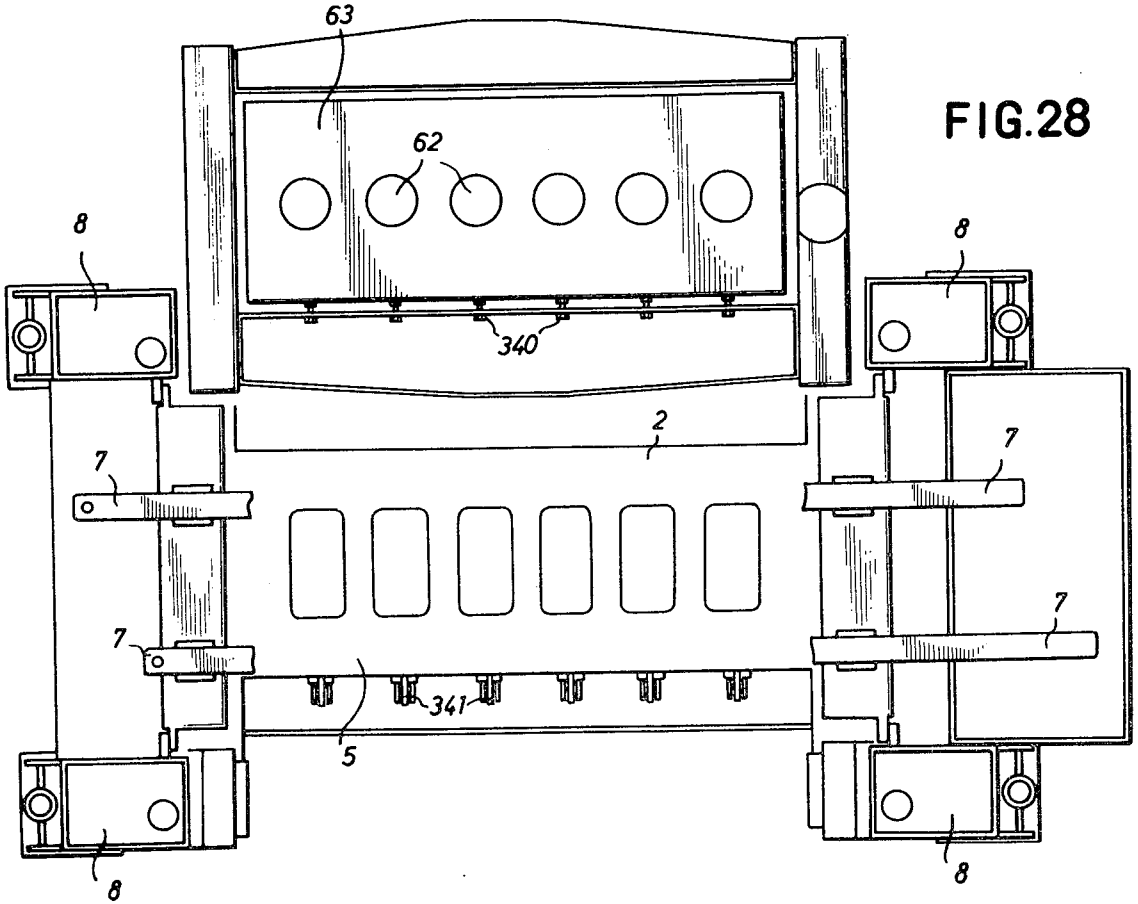
FIG. 28 is a plan view showing the mounting position of the cushion pressure adjusting mechanism.
Figure 29:
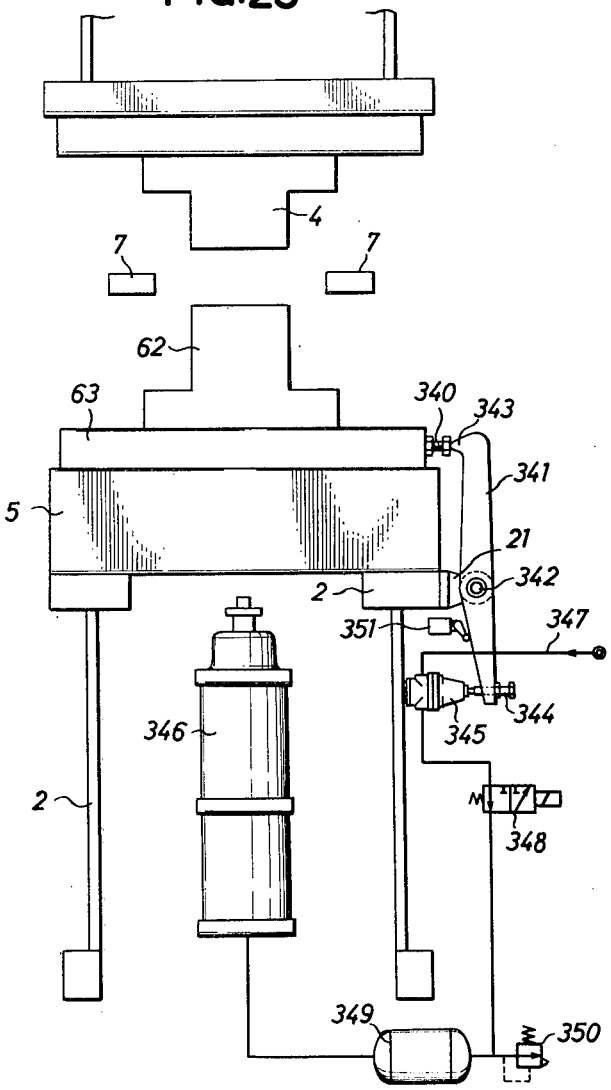
FIG. 29 is a side view of the cushion pressure adjusting mechanism.

In FIGS. 28 and 29 are shown a pressure adjusting mechanism for a cushion cylinder 346 within the bed 2, which mechanism is employed in the transfer-processing in connection with the die exchange operation. Since there is a cushion cylinder 346 at each position corresponding to a die at a stage of transfer-processing for supporting a cushion means (not shown) which in turn supports a blank holding pad (not shown) during a drawing operation (all these parts being conventional in the art); a pressure adjusting mechanism is necessary for each cushion cylinder. This mechanism obtains the necessary pressure from pressure fluid by utilizing the movement of the bolster 5 and operating the regulator 345.

Levers 341 are rotatably mounted on the front surface of the bed 2. At one end of the levers are provided projections 343 which are opposed to adjusting bolts 340 provided on the common plate 63 for lower die, while on the other end are provided threaded rods 344 which are in contact with regulator valves 345 secured to the longitudinal wall of the bed 2. A limit switch 351 which is secured to the longitudinal wall of the bed 2 is contacted by the lever 341.

When a die is to be removed, the bolster 5 moves up with the common plate 63 for the lower die and the adjusting bolts 340 are separated from the projections 343. Then each lever 341 rotates counterclockwise, and the levers 341 move away from the limit switches 351. Each threaded rod 344 is then separated from the corresponding regulator 345, and by the signal from the corresponding limit switch 351, a magnetic valve 348 is operated to permit discharge of pressure fluid from the corresponding cushion cylinder 346, freeing the bolster 5 to run. The bolster, thus freed, runs out of the press 1. The magnetic valve 348 may be operated manually or by other control means before the running of the bolster instead of by the limit switch 351. A pressure fluid tank 349 and a safety valve 350 are connected between the cylinder 346 and valve 348.

When the bolster runs back into the press, the levers 341 are engaged and rotated clockwise and each corresponding pressure fluid circuit is opened by the operation of the magnetic valve.

By rotating the adjusting bolt 340 to adjust the amount it projects from the plate 63, the necessary pressure for the operation of the regulator 345 is obtained through the lever 341.

Figure 30:
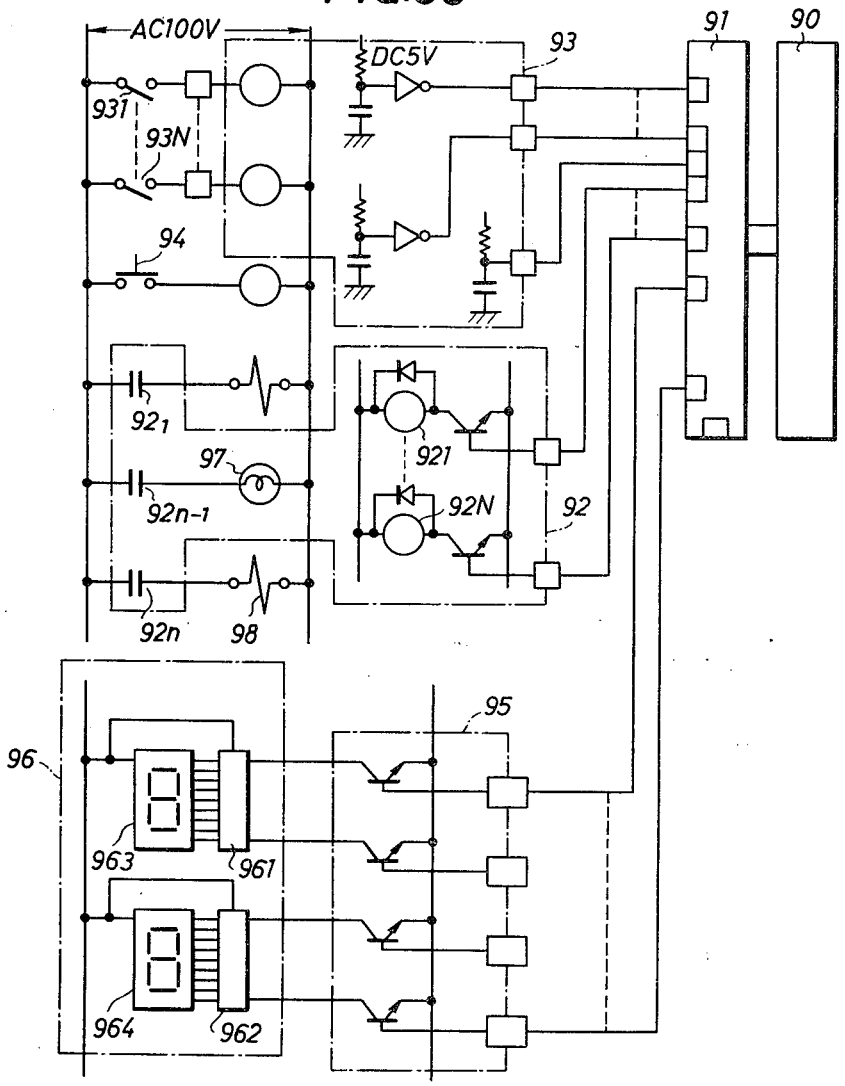
FIG. 30 is a block circuit diagram of the program control mechanism for automatic press operation.
Figure 31:
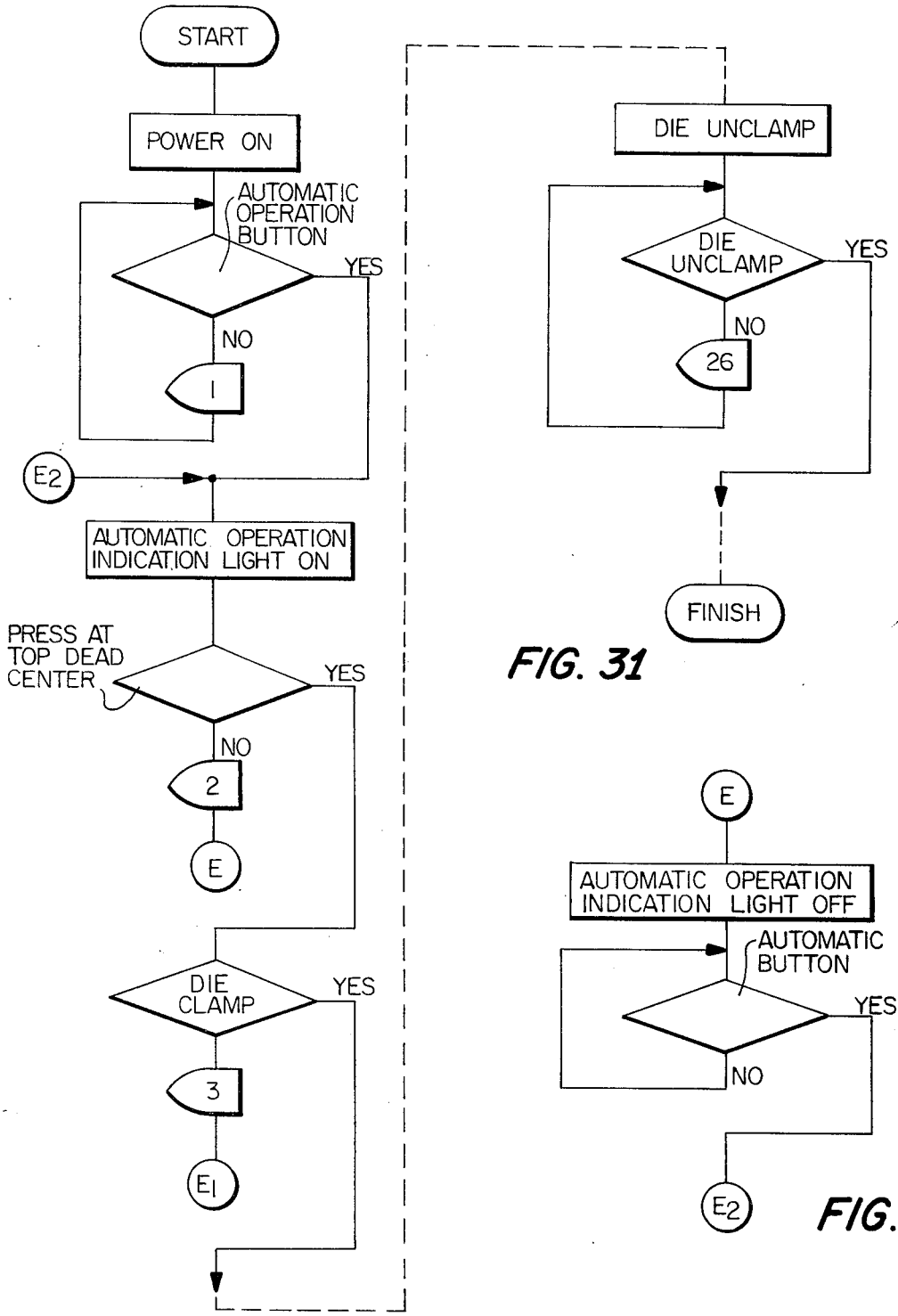
FIG. 31 is a flow chart of the press automatic operation.
Figure 32:
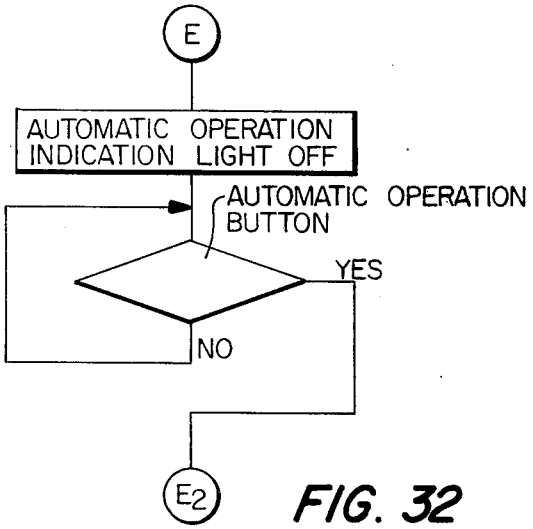
FIG. 32 is a flow chart of the disposal of trouble during automatic press operation.

FIGS. 30–32 show a program control mechanism for the automatic operation of the press. A memory unit 90 which stores programs necessary for automatic operation of the press is composed of 16 bits and a core memory of 1 kilo/word capacity.

An arithmetic unit 91 continuously reads out and decodes the contents stored in the memory unit 90. Using the decoded information, the arithmetic unit puts out control signals to control elements 921–92N of the press so as to operate it. At the same time this unit receives output signals from sensors 931–93N provided at each check point of the press and compares them with the decoded information obtained from the memory unit to judge whether the press is operating according to the instructions of the programs. When it is found that the press is not operating in the proper manner, the arithmetic unit puts out improper operation signals to the indication output unit described below.

The control elements 921–92N are, for example, magnetic switches or magnetic valves which constitute an output unit 92 together with a transistor which drives the control elements according to control signals sent from the arithmetic unit 91.

An input unit 93 connected to the sensors 931–93N supplies DC5V to the arithmetic unit 91 to prevent noise in response to the output signals of the sensors. An automatic operation button 94 is provided to control the start of automatic operation of the press. The sensors 931–93N are respectively located at positions which correspond to the control elements 921–92N.

An indication output unit 95 is constituted by a transistor which amplifies indication signals from the arithmetic unit 91. BCD (Binary Coded Decimal) signals from the transistors of the unit 95 are put into deocders 961 and 962 for producing corresponding decimal numbers on indication panels 963 and 964. When the numbers are two digits, the indication output unit 95 will have eight outputs.

Now, the operation of the present press constituted as described above will be explained with reference to the flow charts shown in FIGS. 31 and 32.

When the power is put on, it is ascertained whether the operator has properly set the automatic operation button 94 at "on" according to the programs in the memory unit 91, and then the automatic operation of the press starts.

"1" signifying "operator's button operation waiting" is indicated on the indication panel 1 after the power is turned on until the automatic operation button 94 is set at "on".

When the button 94 is set at "on", it is ascertained whether the slider of the press is located at the top dead center position. Simultaneously, an automatic operation indication light 97 is lit to indicate that the automatic operation is now under way.

If the slider is not at the top dead center, as shown in FIG. 31 this condition is indicated by the output signal "E2" of the sensor for sensing this condition, the automatic operation indication light 97 is put-out, and "2" signifying that the slide is not at the top dead center is indicated on the indication panel 963 and thus the operator is informed that the automatic operation has not started due to the improper location of the press slide. This procedure is shown in order to FIG. 32.

When the operator manually corrects the position of the slider 187 to the top dead center and the automatic operation button is set once again at "on", the operation proceeds to E2 as a result of the automatic operation button signal as shown in FIG. 32. Then the automatic operation indication signal 97 is once again lit in order to show that the slider is at the top dead center position. When the location of the slider is confirmed, the operation proceeds to the next stage in which the clamping of the die and also other initial conditions of the press are checked.

With the initial condition checks described above, the operator can discover deficient parts in the press in a very short time and start the automatic operation speedily.

After the initial conditions for the automatic operation are properly set up, each stage of the automatic operation follows in sequence, thus running the whole automatic operation by program control.

For example, when the arithmetic unit 91 receives a program for "die unclamp" from the memory unit 90, the control elements (relays) 92N of the output unit 92 are operated according to the information received and the magnetic valve 98 connected to a contact 92n of the control element 92N is also operated.

Then a sensor 93N is operated in order to ascertain whether the "die unclamp" step has really been performed, and a check is made to see whether the necessary signals have been put in from the input unit 93. Since it takes some time to operate the control element 92N, to switch over the valve 98, to remove oil pressure from the die, to unclamp it, and finally to ascertain that "die unclamp" has really taken place, "26" is indicated on the indication panel 963, 964, showing "die unclamp now going on". After confirming that "die unclamp" is properly finished, the operation goes on to the next stage and a series of the automatic operations is completed.

What is claimed is:

1. A transfer press apparatus comprising:

a transfer press having a plurality of stages and a plurality of exchangeable dies;

a blank supply mechanism for supplying blanks;

a blank transport mechanism between said blank supply mechanism and said transfer press for carrying blanks from the said blank supply mechanism to the first stage of said transfer press;

a transfer feed mechanism including exchangeable feed bars extending in the direction of the stages of said transfer press;

a die exchange mechanism for automatic exchange of the dies of said transfer press;

a feed bar exchange mechanism for exchanging said feed bars together with said dies when the dies are exchanged by said die exchange mechanism;

a cushion cylinder at each stage of said transfer press;

a cushion pressure adjusting mechanism connected to each cushion cylinder for supplying necessary pressure to said cushion cylinder and depressurizing said cylinders to free them from the remainder of the transfer press during a die exchange operation; and a program control mechanism connected at least to said transfer feed mechanism, said die exchange mechanism, and said feed bar exchange mechanism for controlling the operation of said mechanism according to the processing of the blanks in said apparatus.

2. A transfer press apparatus as claimed in claim 1 in which said blank transport mechanism comprises means for transferring blanks from said blank supply mechanism one by one to the first stage of said transfer press, said means comprising a transport frame, vacuum cup lifters mounted on said transport frame at intervals corresponding to the spacing of the stages of said press, and means for moving said transport frame parallel and perpendicular to said feed bars.

3. A transfer press apparatus as claimed in claim 2 in which said blank transport mechanism has auxiliary feed bars and said transport frame comprises guide rods and sliding members loosely mounted on said guide rods, said auxiliary feed bars having drive pins thereon on which said sliding members are mounted.

4. A transfer press apparatus as claimed in claim 2 in which said press has rails extending parallel to said feed bars on which said transport frame is movably mounted and cylinder means connected to said rails for vertically moving said rails.

5. A transfer press apparatus as claimed in claim 1 in which said program control mechanism includes a control circuit for controlling continuous operation of said mechanisms, a memory unit connected to said control circuit for providing instructions for the operation of said control circuit, and sensors provided at each stage of operation of said press apparatus for ascertaining whether or not the operation at that stage is properly completed, said sensors being connected to said control circuit for stopping operation thereof when an operation at any stage of the operation is not properly completed.

6. A transfer press apparatus as claimed in claim 1 in which said transfer feed mechanism comprises means for moving in a two-dimensional feeding operation and moving in a three-dimensional feeding operation, and a switch over mechanism connected to said moving means for switching between two-dimensional feeding and three-dimensional feeding.

7. A transfer press apparatus as claimed in claim 6 further having a vertically movable slide, and in which said switch over mechanism includes a cam means movably mounted on the wall of said slide for movement in a direction perpendicular to the direction of movement of said slide, said cam having a first control surface for controlling during two-dimensional feeding and a second control surface for controlling during three-dimensional feeding, a lever pivoted on said press and having a cam follower on one end engaged with said cam means and a rod pivoted to the other end, a clamp and unclamp mechanism connected to said feed bars for operating them, said rod being connected to said clamp and unclamp mechanism for operating it in response to the pivoting of said lever, and a cylinder connected to said cam means for moving said cam means in said perpendicular direction for selectively switching over the engagement of said cam surfaces with said cam follower.

8. A transfer press apparatus as claimed in claim 1 in which said transfer feed mechanism comprises clamp and unclamp units connected to said feed bars for carrying out the clamp and unclamp action of said feed bars and each having a casing, a duplex cylinder for each unit having a piston rod with one end connected to the press and the other end to the side wall of said casing, said duplex cylinder having cylinder portions with different stroke lengths at opposite ends, each cylinder having means for selectively supplying and removing pressure fluid therefrom.

9. A transfer press apparatus as claimed in claim 1 in which said die exchange mechanism comprises bolsters carrying the dies, connecting plates on the bolsters, a slider having driving means for driving said slider, said connecting plates being engageable with said slider for being driven thereby, bolster rails for said bolsters extending rearwardly from the bed of said press at the same level as the upper surface of the bed, said bolsters having wheels running on said rails and carrying said bolsters, truck rails extending in a direction perpendicular to said bolster rails and below said bolster rails, and trucks running on said truck rails and receiving and carrying said bolsters thereon, said truck rails having notches for passing said slider and truck rail sections movable into said notches for filling said notches when said trucks run on said truck rails.

10. A transfer press apparatus as claimed in claim 9 further comprising connecting rods connecting said trucks to each other in pairs.

11. A transfer press apparatus as claimed in claim 1 in which said press has vertical frame members spaced in the direction in which said feed bars extend, said feed bars being shorter than the distance between said vertical frame members, said transfer press further comprising auxiliary feed bars at both ends of said feed bars and to which both ends of said feed bars are connected, and a driving mechanism for driving said auxiliary feed bars.

12. A transfer press apparatus as claimed in claim 1 in which said feed bars have at both ends notched parts and holes therethrough, and said feed bar transfer mechanism has feed bar guides with grooves therein and transfer units secured to said press, and said feed bar exchange mechanism comprises auxiliary feed bars fitted into said grooves in said feed bar guides, one end of said auxiliary feed bars being connected to said transfer units and the other end of said auxiliary feed bars being connected to the notched parts of said feed bars and having connecting pins extending through said holds, a lift cylinder adjacent said feed bars for disengaging said feed bars and said auxiliary feed bars by lifting said feed bars, the piston rod of said lift cylinder having a common plate thereon for supporting the lower dies of said press, and a receiving bed secured to said common plate and supporting said feed bars.

13. A transfer press apparatus as claimed in claim 12 in which said grooves in said feed bar guides have notches in the bottom thereof, and said transfer units each have a slider engaged in said notches for connecting the transfer units to said auxiliary feed bars..

14. A transfer press apparatus as claimed in claim 12 in which said connecting pins provided on said auxiliary feed bars each comprise a piston, a head plate secured to the piston rod of said piston, an elastic body between said head plate and said notched part of said auxiliary feed bars, and an oil supply tube in the notched part of said auxiliary feed bar for supplying pressure fluid to operate said piston.

15. A transfer press apparatus as claimed in claim 1 in which said press has a slide carrying said dies, and said die cooling oil circuit connecting mechanism comprises a plurality of check valves, one for each die, fixed to said slide, each check valve having a body with an opening in the bottom thereof with a seat therearound, a hollow plug body slidable in said body and having a sealing surface on the bottom engageable with said seat, a reduced diameter portion on the lower end of said plug body having a lateral hole therein just above said sealing surface and communicating with the hollow interior of said plug body, the upper portion of said plug body having a lateral opening communicating with the hollow interior of said valve body when said plug body is in the raised postion spaced from said seat, a spring in said valve body urging said valve body toward the valve seat, and said press has a common plate for carrying the upper die and detachably mounted on said slide, said common plate having a recess therein for each die into which the lower end of said valve body projects when said common plate is mounted on said slide, and a cooling oil passage extending therefrom to the corresponding die, and an adjusting bolt extending through said common plate and extending into said recess and through said opening in the bottom of said valve body and engaging the end of said plug body for raising it when said valve body is in said recess.

16. A transfer press apparatus as claimed in claim 1 in which said program control mechanism comprises: a memory unit for storing a program for operation of said press apparatus including operating instructions and proper operation conditions; an arithmetic unit connected to said memory unit for supplying control signals for controlling operation of said press apparatus in response to the instructions from said memory unit and for sensing operating conditions of said press apparatus and comparing them with proper operating conditions from said memory unit; and an indication unit connected to said arithmetic unit for indicating when an operating condition does not correspond with the proper operating condition.

17. A transfer press apparatus as claimed in claim 1 in which each of said exchangeable dies has a die cooling oil circuit therein, said apparatus further comprising a cooling supply circuit and a die cooling oil circuit connecting mechanism connected between said cooling oil supply circuit and the die cooling oil circuits in said dies for disconnecting said cooling oil supply circuit from said die cooling oil circuits at the time of die exchange and connecting said cooling oil supply circuit to the die cooling oil circuits in the newly supplied dies.

* * * * *